US012429296B2

(12) United States Patent
Tippmann, Jr. et al.

(10) Patent No.: US 12,429,296 B2
(45) Date of Patent: Sep. 30, 2025

(54) FIREARM WITH FORWARD CHARGING HANDLE

(71) Applicant: Tippmann Arms Company, LLC, Fort Wayne, IN (US)

(72) Inventors: Dennis J. Tippmann, Jr., Fort Wayne, IN (US); Jonathan Ridgway Finch, Roanoke, IN (US)

(73) Assignee: Tippmann Arms Company, LLC, Fort Wayne, IN (US)

( * ) Notice: Subject to any disclaimer, the term of this patent is extended or adjusted under 35 U.S.C. 154(b) by 0 days.

(21) Appl. No.: 18/431,210

(22) Filed: Feb. 2, 2024

(65) Prior Publication Data

US 2025/0251204 A1 Aug. 7, 2025

Related U.S. Application Data

(60) Provisional application No. 63/443,121, filed on Feb. 3, 2023.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
USPC ..... 89/1.4
See application file for complete search history.

(56) References Cited

U.S. PATENT DOCUMENTS 8,997,620 B2 * 4/2015 Brown ..... F41A 7/00 89/1.4
10,190,834 B2 * 1/2019 Smith ..... F41A 3/72
11,473,863 B2 * 10/2022 Knöpfle ..... F41G 11/003

OTHER PUBLICATIONS

2014 Shot Show—Adcor Defense (https://www.youtube.com/watch?v=HPciQqWlwSk) (Year: 2014).*

* cited by examiner

*Primary Examiner* — Reginald S Tillman, Jr.
(74) *Attorney, Agent, or Firm* — Barnes & Thornburg LLP

(57) ABSTRACT

A firearm having a forward charging handle that allows a shooter to cycle the bolt without significant change in posture or stance. This allows the shooter to overcome ammunition related difficulties without needing to reach to a rear charging handle to cycle the firearm. The forward charging handle may be located near the shooter's support hand on the foregrip/handguard, which reduces the amount of time and positioning needed to cycle the bolt.

19 Claims, 9 Drawing Sheets

FIREARM WITH FORWARD CHARGING HANDLE

RELATED APPLICATIONS

This application claims the benefit of U.S. Provisional App. Ser. No. 63/443,121 filed Feb. 3, 2023 for a "Firearm," which is hereby incorporated by reference in its entirety.

TECHNICAL FIELD

This disclosure generally relates to charging handles for firearms. More specifically, this disclosure relates to a firearm with a charging handle mounted in a forward position and a rear-mounted charging handle.

BACKGROUND

Many different types of firearms, such as M-16s, AR-15s, and the M-4s, use charging handles. The firearm's charging handle facilitates loading a cartridge, ejecting a spent shell casing or unfired cartridge, clearing an obstruction in the rifle's chamber, and verifying that the chamber is empty. In a typical AR-style rifle, the charging handle is located near the back. In some cases, the charging handle is T-shaped with an elongated body and a horizontal crossbar at one end.

In some cases, the firearm may jam or the spent cartridge otherwise needs to be cleared from the action of the firearm. The operator would need to move his/her hand to cycle the rear-located charging handle to try to clear the breech. Generally, this requires the user to pause and alter their posture or stance to cycle the charging handle. Additionally, a rear-located charging handle also may require a user to disengage from the target before cycling the charging handle.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION

Figure 1:
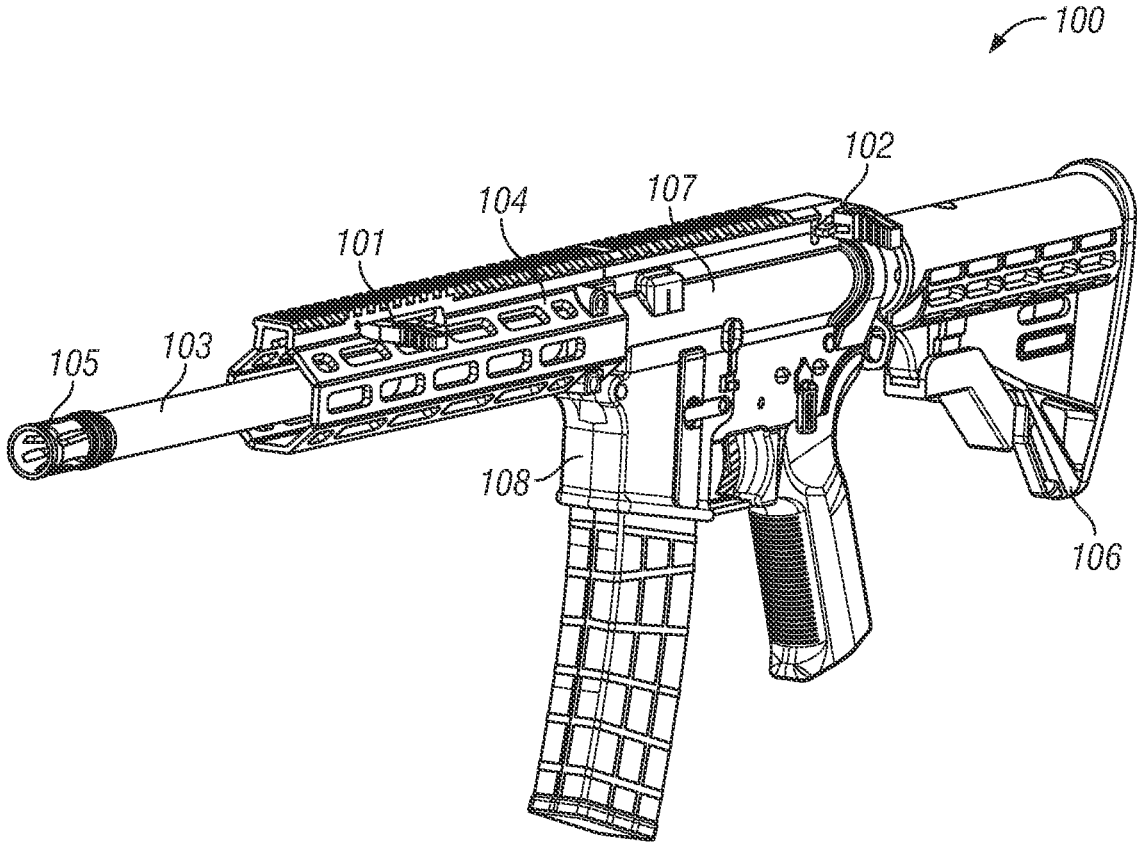
FIG. 1 is a perspective view of an example firearm with a forward and rear charging handle system according to an embodiment of this disclosure.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural features may be shown in specific arrangements. However, it should be appreciated that such specific arrangements may not be required. Rather, in some embodiments, such features may be arranged in a different manner than shown in the illustrative figures. Additionally, the inclusion of a structural in a particular figure is not meant to imply that such feature is required in all embodiments and, in some embodiments, may not be included or may be combined with other features.

According to one aspect, this disclosure is directed towards a charging handle system for a firearm, such as an AR-style rifle or pistol. One skilled in the art should recognize this charging handle system could be applied to any suitable firearm that uses a charging handle, such as an M-16. This charging mechanism allows an operator to cycle the bolt without significant change in posture or stance. This allows the shooter to, among other things, overcome ammunition related difficulties much quicker by not having to reach to the rear of the firearm to cycle the gun. In some embodiments, the forward charging handle is located near the shooters hand on, such as near the foregrip/handguard, which reduces the amount of time and positioning needed to cycle the bolt. In some cases, the front charging handle can be operated by one or more fingers, which is contoured for ergonomics. The front charging handle could be configured to be easily changed in orientation from left to right side of the firearm making it ambidextrous.

Figure 5:
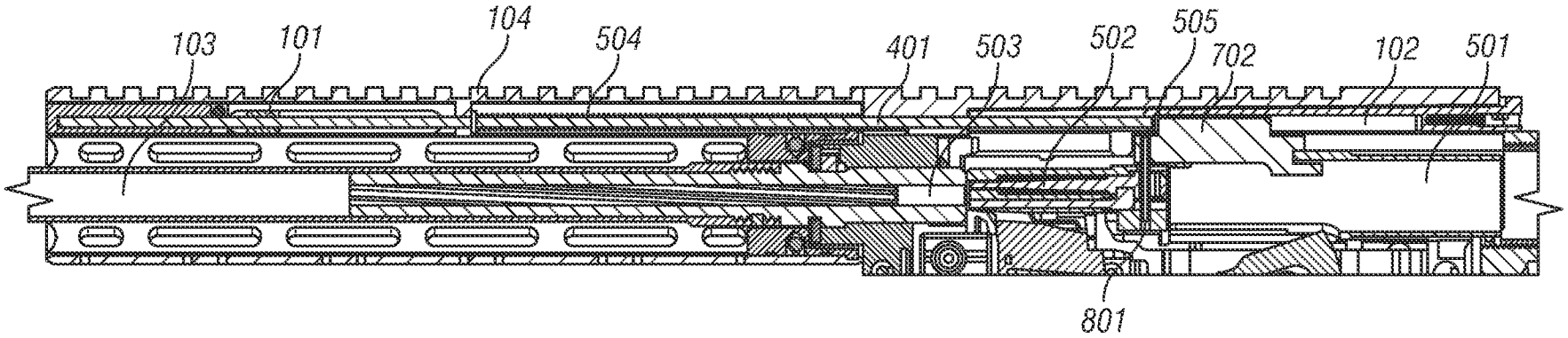
FIG. 5 is a left side detail section view across line 3-3 of the example forward charging handle system shown in FIG. 3.

FIG. 1 shows an example charging handle system 100 installed on an AR-style firearm 108. The firearm 108, in some embodiments, has a barrel 103 with a muzzle device 105, a barrel shroud 104 encircling the barrel 103, a receiver 107, and a stock 106. As shown, the charging handle system 100 includes a forward charging handle 101 and a rear charging handle 102 linked to the firearm's 108 bolt 501 (FIG. 5). The bolt 501 is movable between a locked position and an unlocked position, wherein the locked position corresponds with the firearm being ready to fire and in battery and the unlocked position corresponds with the firearm being unloaded and unable to fire. The forward charging handle 101 and rear charging handle 102 may be linked inside the barrel shroud 104 and the receiver 107. In some embodiments, the bolt 501 (FIG. 5) of the firearm 108 may be cycled using either the forward charging handle 101 and/or the rear charging handle 102. In some cases, both the forward charging handle 101 and the rear charging handle 102 could be non-reciprocating when the bolt 501 (FIG. 5) of the firearm 108 cycles after each shot. In some embodiments, the forward charging handle 101 exerts no force on the rear charging handle 102 when manipulated; likewise, the rear charging handle 102 may be configured to exert no force on the forward charging handle when manipulated. Optionally, the forward charging handle 101 may be located on the opposite side of the barrel 103 and barrel shroud 104 such that left-hand dominate shooters may use the forward charging handle 101.

Figure 2:
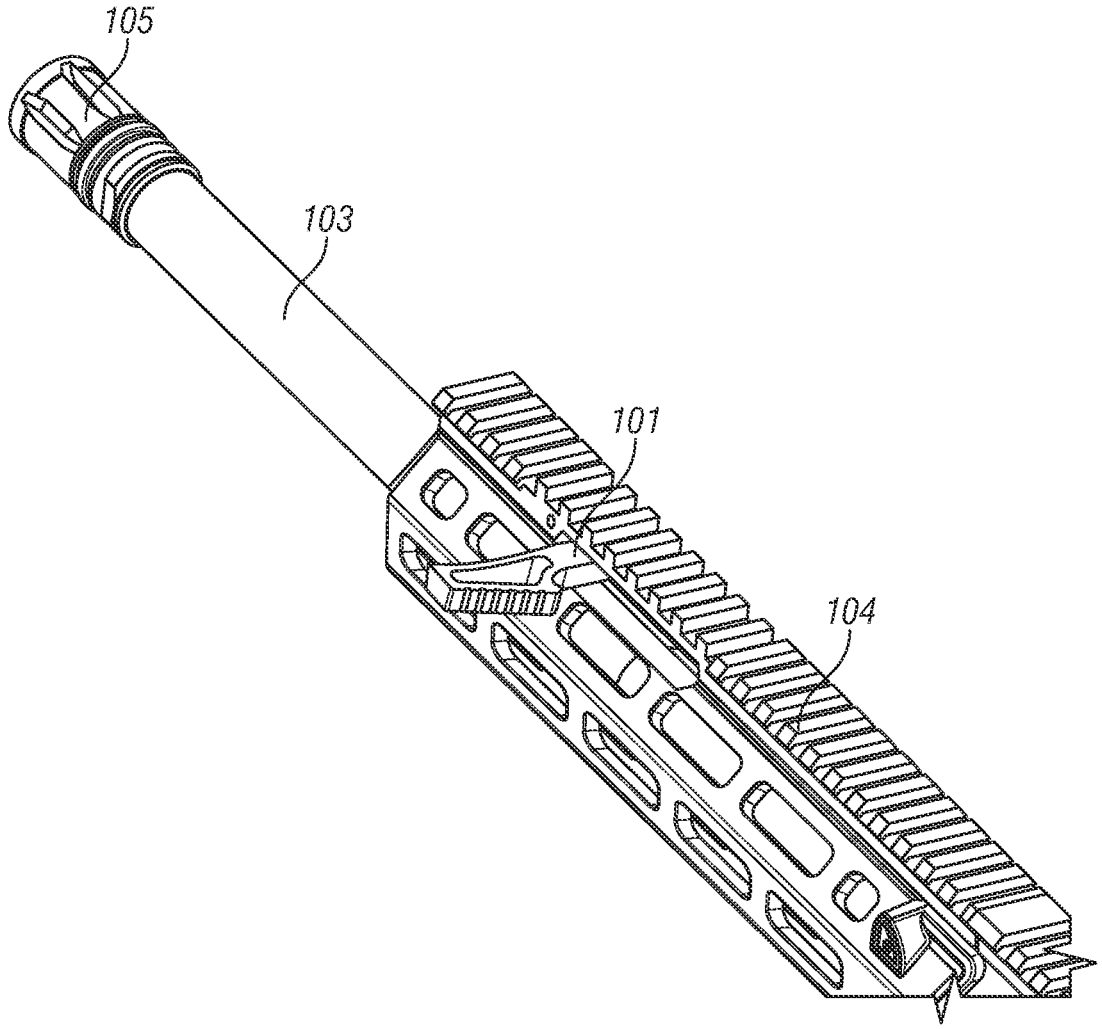
FIG. 2 is a detailed, front perspective view of the example forward charging handle shown in FIG. 1.

FIG. 2 shows an embodiment with the forward charging handle 101 located within the barrel shroud 104. Optionally, the forward charging handle 101 may be reversed to the opposite side of the barrel 103 and barrel shroud 104 such that left-hand dominate shooters may more easily use the forward charging handle 101. One skilled in the art should recognize that any shape and/or size suitable for gripping with the human hand may be employed as the forward charging handle 101.

Figure 3:
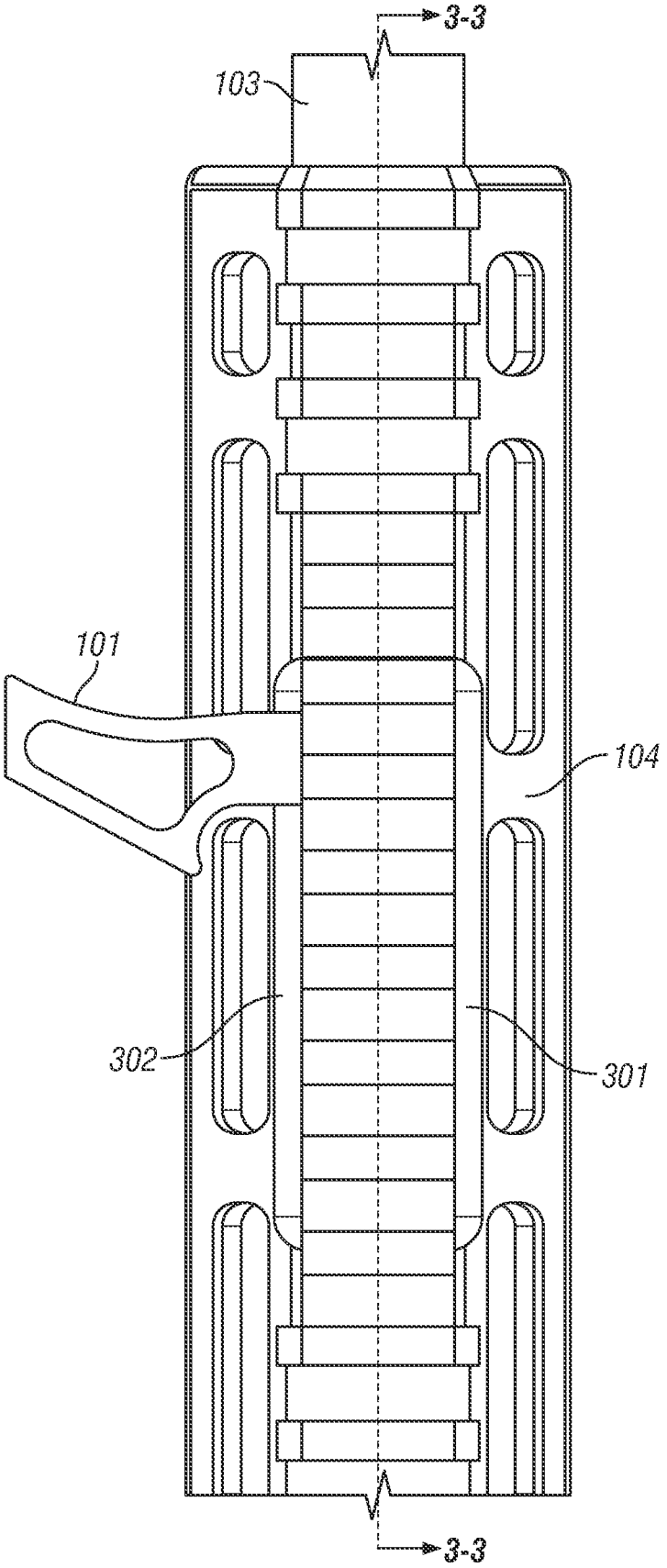
FIG. 3 is a detailed, top view of the example forward charging handle system shown in FIG. 1.

Referring to FIG. 3, there is an embodiment in which the forward charging handle 101 is located within the barrel shroud 104. As shown, a pair of horizontal slots 301, 302 are located on the barrel shroud 104 to allow the forward charging handle 101 to cycle the bolt 501 (FIG. 5). In this embodiment, the pair of horizontal slots 301, 302 are disposed parallel to the barrel 103. As shown, the pair of horizontal slots 301, 302 are sized such that cycling the forward charging handle 101 the full length of the pair of horizontal slots 301, 302 cycles the bolt 501 (FIG. 5) of the firearm 108.

Figure 4:
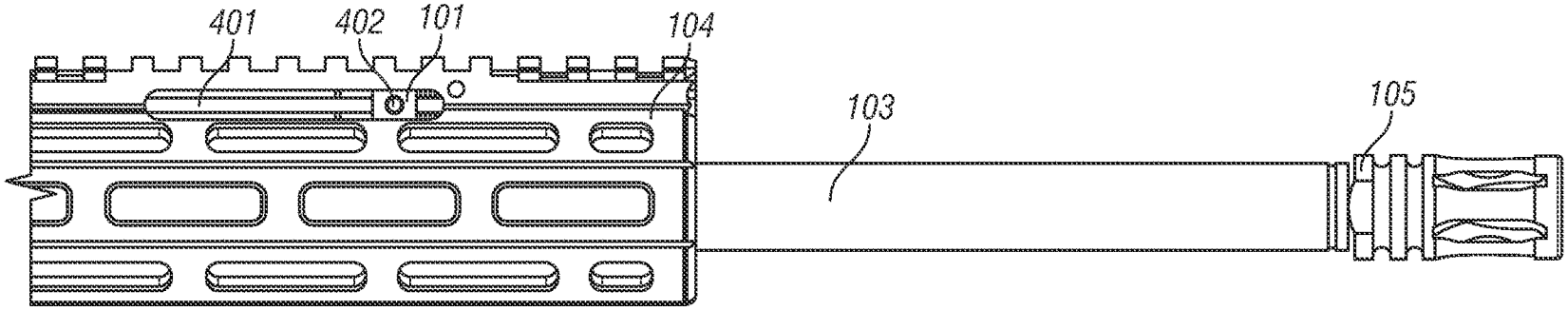
FIG. 4 is a detailed, right side view of the example forward charging handle system shown in FIG. 1.

Turning next to FIG. 4, a detail view of the opposite side of the forward charging handle 101 is shown. In the embodiment shown, the forward charging handle 101 is linked to the firearm's 108 bolt 501 (FIG. 5) via a linking arm 401 that extends from the forward charging handle 101 through the barrel shroud 104 and the receiver 107 to the firearm's 108 bolt 501 (FIG. 5). This allows the user of the firearm 108 to cycle the bolt 501 (FIG. 5) of the firearm using either the forward charging handle 101 or the rear charging handle 102. As shown, the forward charging handle 101 is secured on to the linking arm 401 with a set screw 402. This allows the forward charging handle 101 to be easily removed, replaced, or modified to be attached to the opposite side of the firearm 108, such that left-handed shooters can use the forward charging handle 101.

FIG. 5 illustrates a sectional view taken along line 3-3 of FIG. 3 of an embodiment in which the forward charging handle 101 is on the forward part of the barrel shroud 104 above the barrel 103. As shown, the forward charging handle further includes a biasing member, which is a spring 504, configured to urge the forward charging handle to a forward position after it is used to cycle the bolt 501 of the firearm 108. In this embodiment, the linking arm 401 links the forward charging handle to the bolt 501 of the firearm 108.

As shown, the charging flag 702 allows either the forward charging handle 101 or the rear charging handle 102 to cycle the bolt 501 of the firearm 108 without both the forward charging handle 101 and rear charging handle 102 moving simultaneously. In some embodiments, the charging flag 702 further comprises a roll pin 801 or similar securement mechanism to couple the charging flag 702 to the bolt 501 of the firearm 108. The charging flag 702 further comprises an actuation surface 505. The forward charging handle 101 is coupled to the linking arm 401. When the forward charging handle 101 is actuated by a user, the linking arm 401 acts on the actuation surface 505 which in turn actuates the bolt 501 putting the gun into battery. When the rear charging handle 102 is actuated by a user, the rear charging handle 102 acts directly on the actuation surface 505, which in turn actuates the bolt 501 putting the gun into battery. Depending on the circumstances, embodiments are contemplated in which the forward charging handle 101 and rear charging handle 102 could be linked together to move simultaneously.

If the forward charging handle 101 is used to load a round, the operator pulls the forward charging handle 101, which moves the linking arm 401 rearward, thereby, pushing the charging flag 702 by acting upon the actuation surface 505 which acts upon the bolt 501. When the forward charging handle 101 is released, the bolt 501 has been released, and the forward charging handle 101 advances forward from urging of spring 504 located around the linking arm 401.

If the rear charging handle 102 is used to load a round, the rear charging handle 102 is pulled rearward, pulling the charging flag 702 with it. This in turn acts upon the bolt 501. When the rear charging handle 102 is released the charging flag 702, acted upon by forces of the bolt 501 in turn moves forward, bringing the rear charging handle 102 forward to the closed position. The rear charging handle 102 is then held into this position by a latch (not shown).

Figure 6:
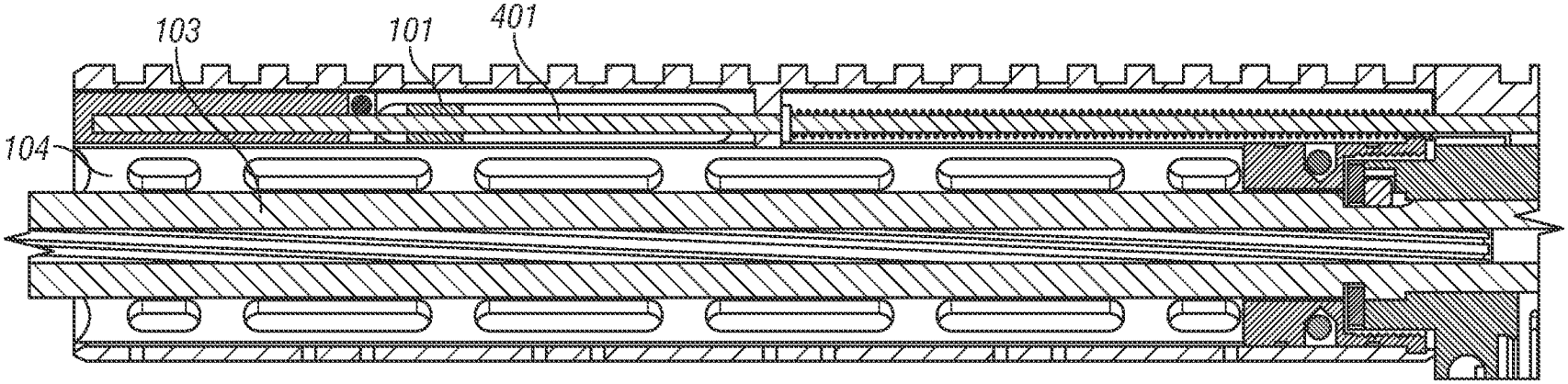
FIG. 6 is a left side detail view showing the example forward charging handle system shown in FIG. 5 near the front of the barrel.

FIG. 6 shows the forward charging handle 101 in further detail along with the linking arm 401. In this embodiment, the linking arm 401 is located parallel to the barrel 103 within the barrel shroud 104.

Figure 7:
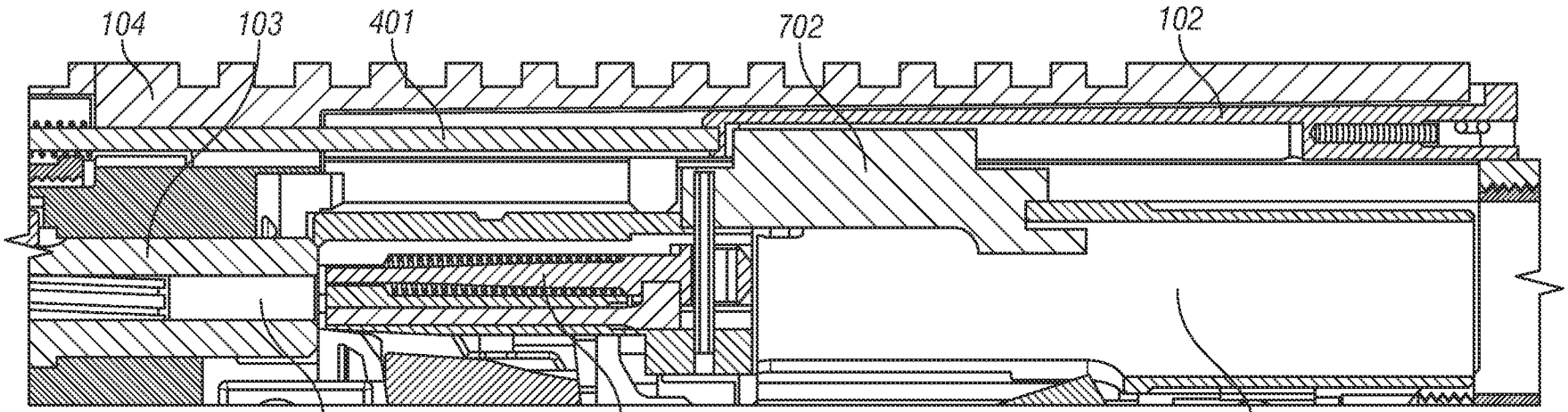
FIG. 7 is a left side detail view of the example forward charging handle system shown in FIG. 5 near the rear of the barrel.

FIG. 7 shows the bolt 501 of the example firearm 108 in additional detail. In the embodiment shown, the charging flag 702 allows either the forward charging handle 101 or the rear charging handle 102 to cycle the bolt 501 of the firearm 108 without both the forward charging handle 101 and rear charging handle 102 moving simultaneously. When either the forward charging handle 101 or rear charging handle 102 is cycled, the bolt 501 is actuated. The bolt 501 is actuated via the charging flag 701 by either the forward charging handle 101 or the rear charging handle 102 to load a cartridge (not shown) into the breech 503 and prime the firing pin 502. This renders the firearm 108 loaded and ready to fire.

Figure 8:
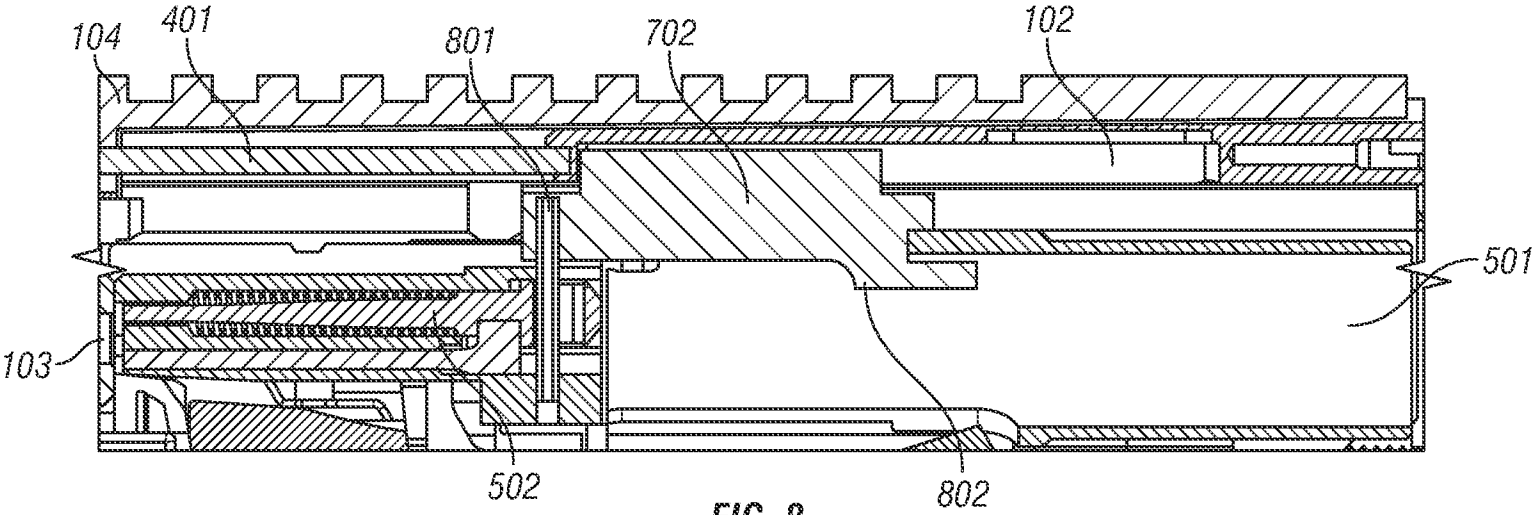
FIG. 8 is a detail view of an example connected charging flag of the example forward charging handle system shown in FIG. 5.
Figure 9:
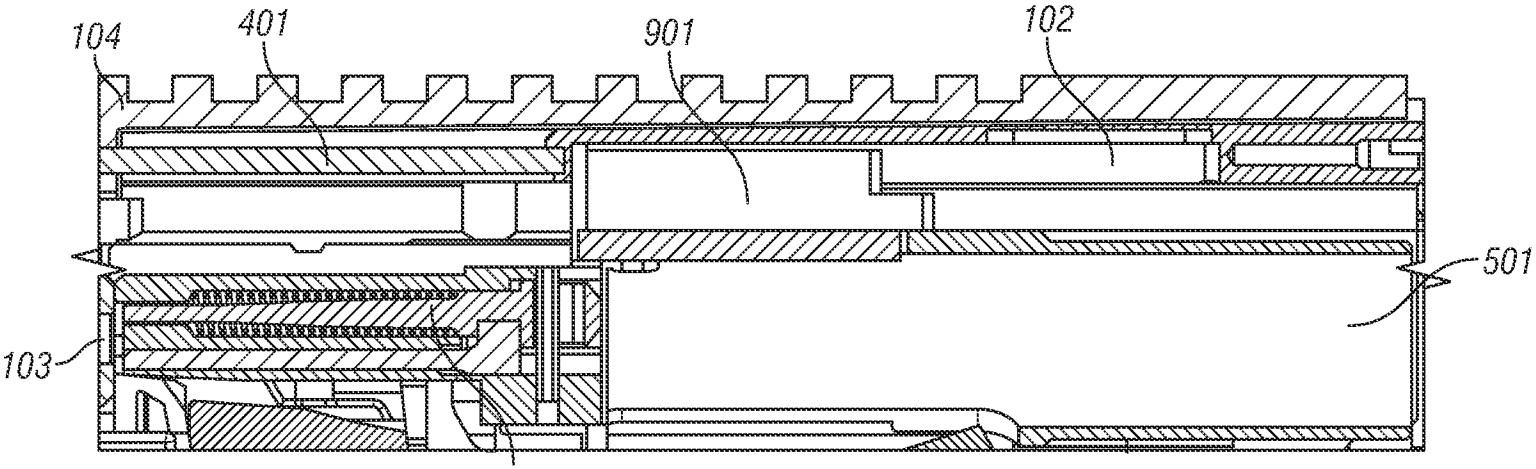
FIG. 9 is a detail view of an example floating charging flag of the forward charging handle system shown in FIG. 5.

FIGS. 8 and 9 show additional embodiments of the charging flag 702. In FIG. 8, a charging flag 702 that is secured via the roll pin 801 or other suitable mechanical fastener to the bolt 501 of firearm 108 is shown. The charging flag 702 of FIG. 8 further has a tab 802 at the base of the charging flag 702 configured to engage the bolt 501. In FIG. 9, a floating charging flag 901 is shown that is not secured to the firearm 108. The floating charging flag 901 has no mechanical connection or interlocking features with the bolt 501. The floating charging flag 901 further does not comprise a tab 802 to engage the bolt. Both the fixed charging flag 702 and the floating charging flag 901 comprise the actuation point 505 at the same location to be acted upon by either the forward charging handle 101 or the rear charging handle 102. A benefit of the floating charging flag 901 is that it does not require the roll pin 801 to secure it to the bolt 501, and is secured via a friction fit. The rear charging handle 102 has a slot cut in its face such that it can interact with the charging flag 702.

Figure 10:
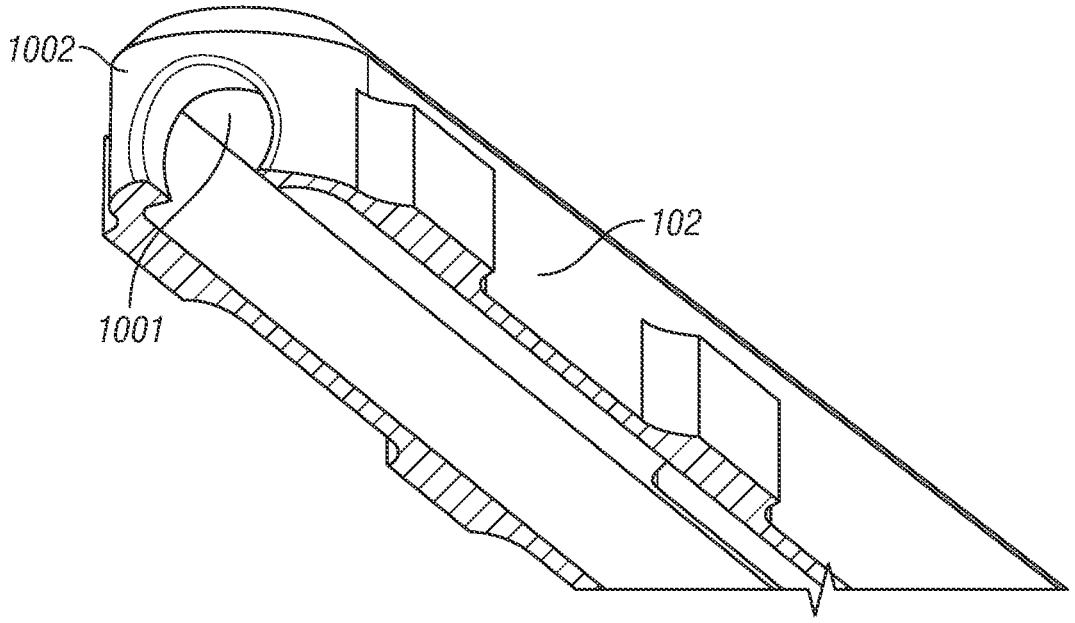
FIG. 10 is a detail view showing a slot in the rear charging handle to allow the forward charging handle to operate independently.

FIG. 10 shows the rear charging handle 102. The rear charging handle 102 is located adjacent to the receiver 107 of the firearm 108, near the stock 106. The rear charging handle 102 further is located parallel to the barrel 103. The rear charging handle 102 has a first end 1002 and a second end (not shown). The first end 1002 of the rear charging handle 102 is located facing the muzzle device 105. The second end (not shown) of the rear charging handle 102 is located facing the stock 106. The first end 1002 of the rear charging handle 102 further has a recess 1001. The second end (not shown) of the rear charging handle 102 may comprise a finger pull to allow a firearm 108 user to cycle the bolt 501. The linking arm 401, which is coupled to the forward charging handle 101, passes through the recess 1001 to engage the charging flag 702. The recess 1001 allows the forward charging handle 101 or the rear charging handle 102 to cycle the bolt 501 via the charging flag 702.

In some embodiments, if the forward charging handle 101 is used to cycle the bolt 501, the recess allows the bolt 501 to cycle without interference from the rear charging handle 102. In other or the same embodiments, if the rear charging handle 102 is used to cycle the bolt 501, the recess allows the bolt 501 to cycle without interference from the forward charging handle 101.

Figure 11:
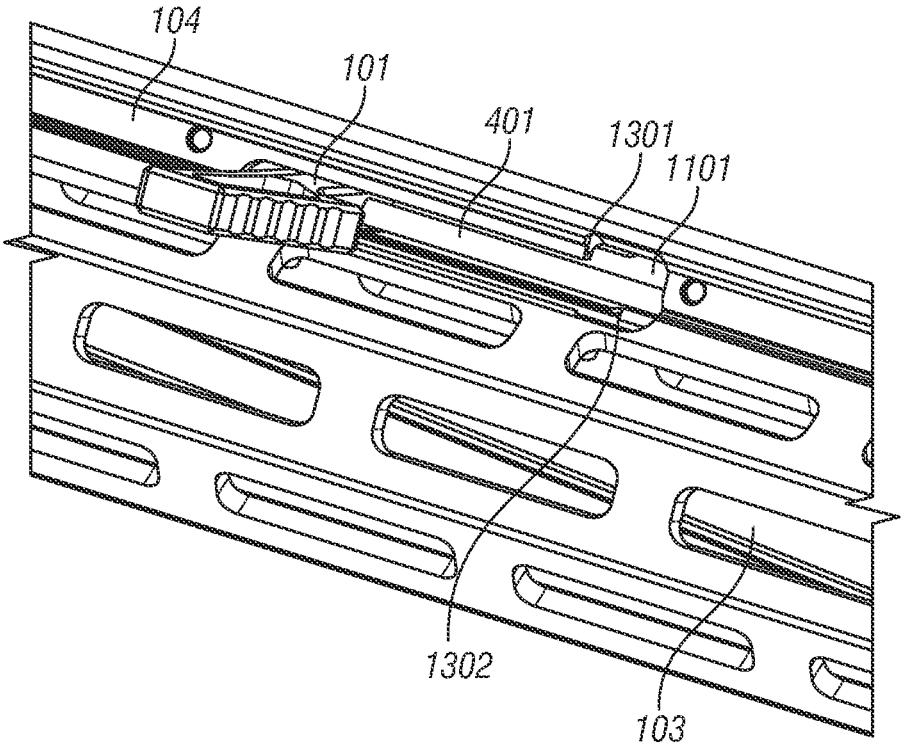
FIG. 11 is a detailed rear perspective view showing a lock cut-out for the forward charging handle system.
Figure 12:
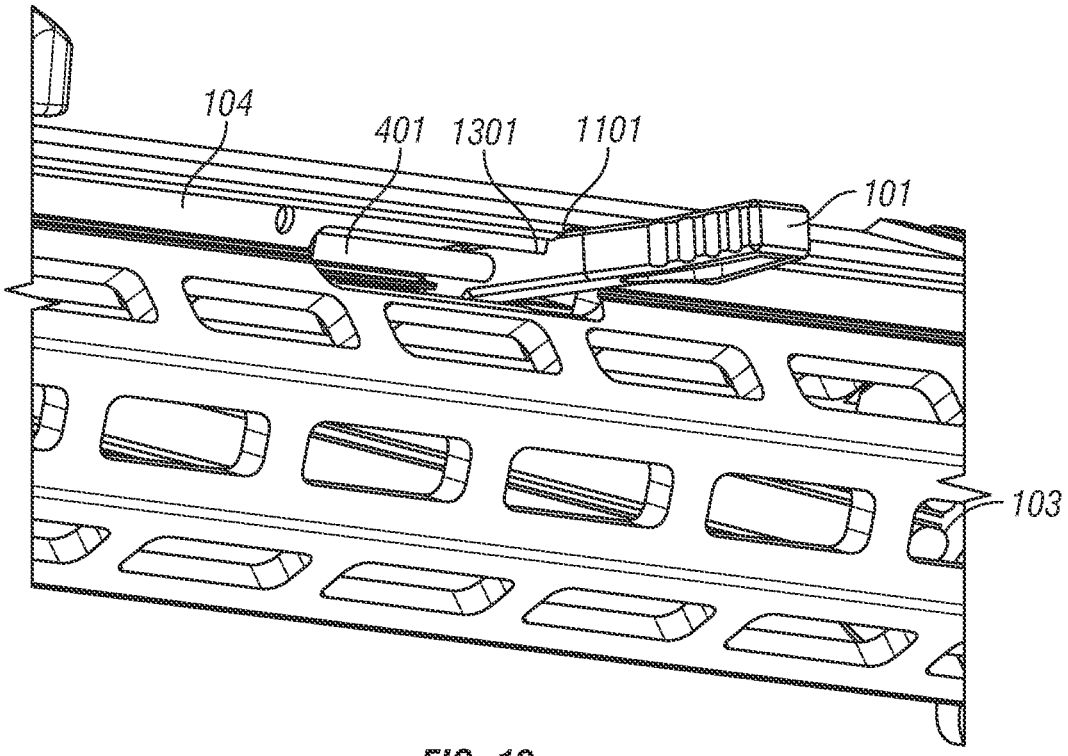
FIG. 12 is a detailed front perspective view showing the lock cut-out of FIG. 11.

FIG. 11 shows a lock cut-out 1101 in the barrel shroud 104 of the firearm 108. The lock cut-out 1101 permits the forward charging handle 101 to be locked in a backward position, which locks the bolt 501 in an open position. In the embodiment shown, the lock cut-out 1101 is an opening defined within the barrel shroud 104, which could have the approximate width of the forward charging handle 101. As shown, there could be one or more tabs 1301, 1302 (See also FIG. 13) that latches the forward charging handle 101 in the backward position to prevent forward movement when the forward charging handle is latched. To latch the forward charging handle 101, the forward charging handle 101 is pulled back parallel to the barrel 103 such that the forward charging handle 101 is aligned with the lock cut-out 1101. Once the forward charging handle 101 is aligned with the lock cut-out 1101, the forward charging handle 101 may be biased upward relative to the ground, as shown in FIG. 12, about the linking arm 401 from the user's shooting position into the lock cut-out 1101 such that the one or more of the tabs 1301, 1302 engages a portion of the forward charging handle 101. This will lock the forward charging handle 101 into the lock cut-out 1101, and further, lock the bolt 501 open and prevent the firearm 108 from going into battery. When the bolt 501 is locked open, the firearm 108 can then be loaded. Once the firearm 108 has been loaded, the forward charging handle 101 must be biased downward relative to the ground (as shown in FIG. 11) from the user's shooting position so the one or more tabs 1301, 1302 no longer engage a portion of the forward charging handle 101. This will release the bolt 501 and send the bolt 501 forward due to urging of the bolt spring, putting the firearm 108 into the battery.

FIG. 12 shows the forward charging handle 101 locked back into the lock cut-out 1101. When the forward charging handle 101 is locked back in the lock cut-out 1101 as shown in FIG. 12, the bolt 501 is locked open. This allows the firearm 108 to be loaded. As shown in some embodiments, such as FIG. 12, the forward charging handle 101 is rotated biased upward relative to the ground (as shown in FIG. 12) from the user's shooting position, in order to lock the forward charging handle 101 into the one or more tabs 1301, 1302 of the lock cut-out 1101.

Figure 13:
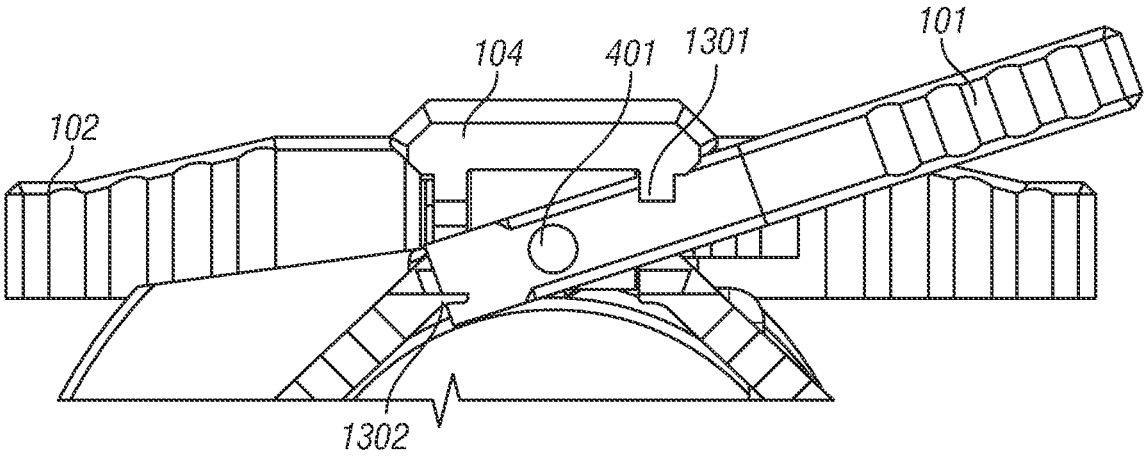
FIG. 13 is a front elevation view showing the lock cut-out of FIG. 11.

FIG. 13 shows a front view of the forward charging handle 101 locked back into the lock cut-out 1101. The lock cut-out 1101 further comprises two lock tabs, 1301 and 1302, which engage the forward charging handle 101 once it has been biased upward relative to the ground about the linking arm 401. The two lock tabs, 1301 and 1302 are protrusions off the barrel shroud 104 that are configured to engage the forward charging handle 101. When the forward charging handle 101 is biased upward relative to the ground (as shown in FIG. 13), the two lock tabs 1301 and 1302 engage the forward charging handle 101 locking it in place and locking the bolt 501 open. When the forward charging handle 101 is biased downward relative to the ground (as shown in FIG. 11), the two lock tabs 1301 and 1302 disengage the forward charging handle 101 and allow it to be sent back forward by the spring 504, closing the bolt 501 and putting the firearm 108 into battery.

Figure 14:
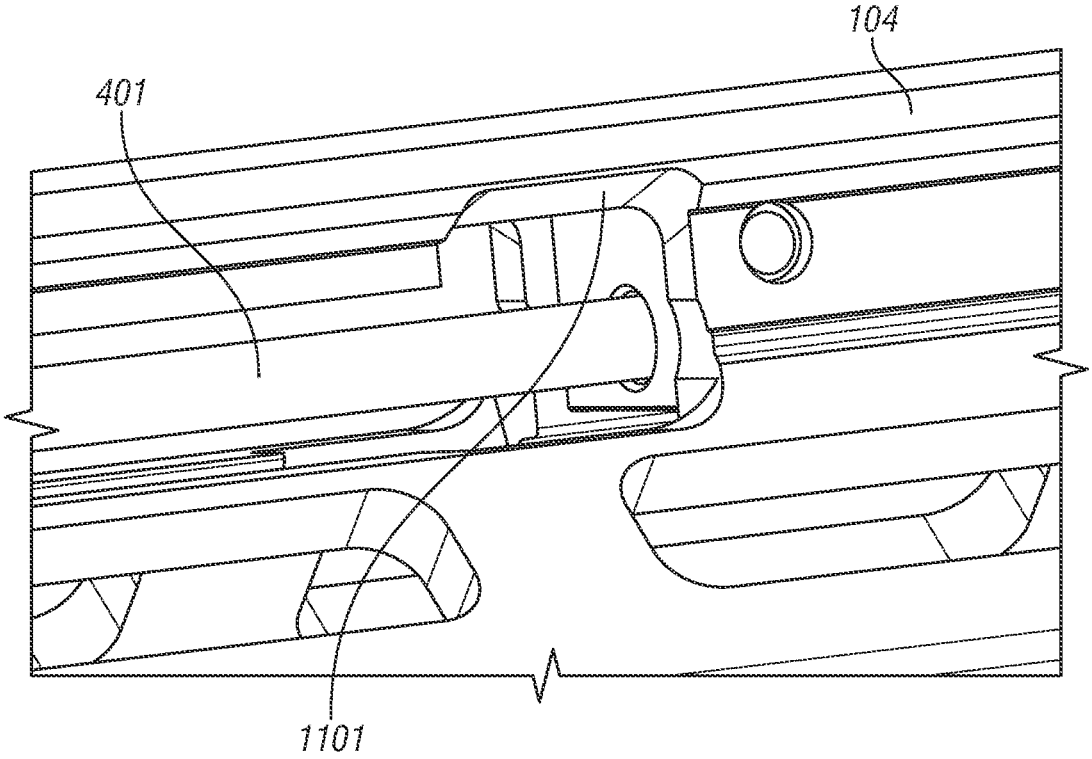
FIG. 14 is a detail view showing the lock cut-out of FIG. 11.

FIG. 14 shows a detail view of the lock cut-out 1101. The barrel shroud 104 comprises the lock cut-out 1101 such that the forward charging handle 101 can be locked by biasing the forward charging handle 101 upwards relative to the ground (as shown in FIG. 12 and FIG. 13) about the linking arm 401 and unlocked by biasing the forward charging handle 101 downwards towards the ground (as shown in FIG. 11) about the linking arm 401.

It is to be understood that the invention is not limited to the exact details of construction, operation, exact materials or embodiments shown and described, as obvious modifications and equivalents will be apparent to one skilled in the art. While the specific embodiments have been illustrated and described, numerous modifications come to mind without significantly departing from the spirit of the invention, and the scope of protection is only limited by the scope of the accompanying Claims.

The invention claimed is:

1. A firearm comprising:

a firearm housing;

a firing assembly disposed within the housing and including a bolt movable along a longitudinal axis between a first position and a second position;

a forward charging handle with at least a portion positioned in front of the bolt and comprising a linking arm movable along the longitudinal axis to move the bolt towards the second position when the linking arm moves in a first direction;

a rear charging handle with at least a portion positioned behind the bolt and comprising an elongated portion movable along the longitudinal axis to move the bolt toward the second position when the elongated portion moves in the first direction; and wherein the linking arm is a solid rod without internal bore.

2. The firearm of claim 1, wherein the forward charging handle is configured to independently move the bolt towards the second position when the linking arm moves in the first direction without correspondingly moving the rear charging handle.

3. The firearm of claim 2, wherein the rear charging handle is configured to independently move the bolt towards the second position when the elongated portion moves in the first direction without correspondingly moving the forward charging handle.

4. The firearm of claim 1, further comprising a charging flag extending above the bolt, wherein the forward charging handle is configured to actuate the charging flag when the forward charging handle moves in the first direction.

5. The firearm of claim 4, wherein the linking arm operatively connects the forward charging handle and the charging flag.

6. The firearm of claim 5, wherein the linking arm includes a first end connected to the forward charging handle and a second end adjacent the charging flag.

7. The firearm of claim 4, wherein the rear charging handle is configured to actuate the charging flag when the elongated portion moves in the first direction.

8. The firearm of claim 7, wherein the charging flag includes an actuation surface upon which the linking arm and the elongated portion of the rear charging handle actuate the charging flag.

9. The firearm of claim 4, wherein the charging flag is movably coupled to the firearm housing via a friction fit or a mechanical connector.

10. The firearm of claim 1, wherein the forward charging handle is configured to extend transversely from a first side of a barrel or a second side of the barrel, thereby being ambidextrous.

11. The firearm of claim 1, wherein the forward charging handle further comprises a charging handle located proximate a muzzle of the firearm.

12. The firearm of claim 1, wherein the rear charging handle further comprises a charging handle located proximate a stock of the firearm.

13. A method of actuating a firearm bolt using a forward charging handle and a rear charging handle, the method comprising:

providing a firearm in which a bolt is independently movable by a forward charging handle and a rear charging handle;

pulling back on a forward charging handle to move the bolt towards a first bolt position;

rotating the forward charging handle up into a first position;

inserting a loaded magazine into a magazine well of a firearm;

placing a dominant hand proximate a trigger;

rotating the forward charging handle down into a second position;

placing a support hand along a barrel shroud;

upon encountering a jam, clearing the jam by pulling back on a forward charging handle with the support hand without needing to move the dominant hand away from the trigger.

14. The method of claim 13, wherein the first position of the forward charging handle corresponds with an open position of the bolt.

15. The method of claim 13, wherein the second position of the forward charging handle corresponds with a closed position of the bolt.

16. The method of claim 13, wherein at least a portion of the forward charging handle extends longitudinally in front of the bolt.

17. The firearm of claim 1, further comprising a barrel shroud with a lock cut-out, wherein the forward charging handle is rotatable to be latched with the lock cut-out to prevent the bolt from moving from the second position to the first position.

18. A firearm comprising:

a firearm housing;

a firing assembly disposed within the housing and including a bolt movable along a longitudinal axis between a first position and a second position;

a forward charging handle with at least a portion positioned in front of the bolt and comprising a linking arm movable along the longitudinal axis to move the bolt towards the second position when the linking arm moves in a first direction;

a rear charging handle with at least a portion positioned behind the bolt and comprising an elongated portion movable along the longitudinal axis to move the bolt toward the second position when the elongated portion moves in the first direction;

a barrel shroud with a lock cut-out, wherein the forward charging handle is rotatable to be latched with the lock cut-out to prevent the bolt from moving from the second position to the first position;

wherein the elongated portion of the rear charging handle includes a recess and at least a portion of the linking arm passes into the recess when the linking arm moves the bolt towards the second position; and wherein the forward charging handle is configured to independently move the bolt towards the second position when the linking arm moves in the first direction without correspondingly moving the rear charging handle, wherein the rear charging handle is configured to independently move the bolt towards the second position when the elongated portion moves in the first direction without correspondingly moving the forward charging handle.

19. A firearm comprising:

a firearm housing;

a firing assembly disposed within the housing and including a bolt movable along a longitudinal axis between a first position and a second position;

a forward charging handle with at least a portion positioned in front of the bolt and comprising a linking arm movable along the longitudinal axis to move the bolt towards the second position when the linking arm moves in a first direction;

a rear charging handle with at least a portion positioned behind the bolt and comprising an elongated portion movable along the longitudinal axis to move the bolt toward the second position when the elongated portion moves in the first direction;

a barrel shroud with a lock cut-out, wherein the forward charging handle is rotatable to be latched with the lock cut-out to prevent the bolt from moving from the second position to the first position; and wherein the linking arm is a solid rod.

* * * * *